US010515498B2

(12) United States Patent
Chang et al.

(10) Patent No.: US 10,515,498 B2
(45) Date of Patent: Dec. 24, 2019

(54) ELECTRIC LOCK AND CONTROL METHOD THEREOF

(71) Applicant: TAIWAN FU HSING INDUSTRIAL CO., LTD., Kaohsiung (TW)

(72) Inventors: Pi-Shun Chang, Kaohsiung (TW); I-Chang Shih, Tainan (TW); Shih-Min Lu, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 0 days.

(21) Appl. No.: 16/232,080

(22) Filed: Dec. 26, 2018

(65) Prior Publication Data

US 2019/0206165 A1 Jul. 4, 2019

Related U.S. Application Data

(63) Continuation-in-part of application No. 15/966,001, filed on Apr. 30, 2018, now Pat. No. 10,169,940.

(30) Foreign Application Priority Data

Jan. 4, 2018 (TW) ..... 107100342 A
Dec. 25, 2018 (TW) ..... 107146952 A

(51) Int. Cl.
*G07C 9/00* (2006.01)

(52) U.S. Cl.
CPC ..... *G07C 9/00309* (2013.01); *G07C 9/00571* (2013.01); *G07C 2009/00412* (2013.01); *G07C 2009/00769* (2013.01)

(58) Field of Classification Search
CPC ..... G07C 9/00309; G07C 9/00571
USPC ..... 340/5.6–5.65
See application file for complete search history.

(56) References Cited

U.S. PATENT DOCUMENTS 8,990,927 B2 * 3/2015 Al-Azzawi ..... G07C 9/00182 726/19
9,728,022 B2 8/2017 Gengler
RE46,539 E * 9/2017 Fisher
2007/0197261 A1 * 8/2007 Humbel ..... G06Q 30/00 455/558
2012/0068817 A1 * 3/2012 Fisher ..... G07C 9/00571 340/5.61
2012/0213362 A1 * 8/2012 Bliding ..... G07C 9/00309 380/44
2012/0306617 A1 * 12/2012 Tung ..... G07C 9/00309 340/5.54
2013/0090744 A1 * 4/2013 Tran ..... G05B 11/01 700/9

(Continued)

FOREIGN PATENT DOCUMENTS

CA 2 955 795 A1 2/2016
WO 2016/028697 A1 2/2016

*Primary Examiner* — Allen T Cao
(74) *Attorney, Agent, or Firm* — Winston Hsu

(57) ABSTRACT

A control method for operating an electric lock by using a portable device includes the portable device obtaining an encrypted message according to an encryption function; the portable device transmitting the encrypted message to the electric lock; the electric lock decrypting the encrypted message according to a decryption function; and the electric lock determining whether to perform an action according to a decryption result of the encrypted message.

17 Claims, 16 Drawing Sheets

(56) References Cited

U.S. PATENT DOCUMENTS

| | | | | |
|---|---|---|---|---|
| 2014/0340195 | A1* | 11/2014 | Polak | G07C 9/00571 340/5.61 |
| 2014/0375422 | A1* | 12/2014 | Huber | G07C 9/00174 340/5.61 |
| 2015/0222517 | A1* | 8/2015 | McLaughlin | H04W 4/70 713/156 |
| 2019/0122293 | A1* | 4/2019 | Minsely | G07F 17/12 |

* cited by examiner

ELECTRIC LOCK AND CONTROL METHOD THEREOF

CROSS REFERENCE TO RELATED APPLICATIONS

This application is a continuation-in-part of U.S. application Ser. No. 15/966,001, filed Apr. 30, 2018. This application claims the benefit of U.S. application Ser. No. 15/966,001, which was filed on Apr. 30, 2018, and is incorporated herein by reference.

BACKGROUND OF THE INVENTION

1. Field of the Invention

The present invention relates to an electric lock and a control method thereof, and more particularly, to an electric lock being operated by a portable device and a control method thereof.

2. Description of the Prior Art

Generally speaking, a conventional electric lock is set with a default password. A user can input the default password via an input interface to unlock the electric lock. For example, the input interface can be a numeric keypad which includes a set of numerical buttons disposed on an outside of a door, and the default password can be a set of numbers. When the set of numbers is correctly inputted via the numeric keypad, the electric lock can be unlocked. However, when the host of the electric lock performs the unlocking operation, it is hard to prevent people with bad intentions from obtaining the default password by peeping and skimming. Alternatively, the permutation combination of the numerical buttons are limited, people with bad intentions can crack the default password by trying different permutation combination of the numerical buttons. Therefore, the safety of the conventional electric lock needs to be strengthened.

SUMMARY OF THE INVENTION

A purpose of the present invention is to provide an electric lock and a control method thereof for solving above drawbacks.

According to an embodiment of the present invention, a control method for operating an electric lock by using a portable device includes the portable device obtaining an encrypted message according to an encryption function; the portable device transmitting the encrypted message to the electric lock; the electric lock decrypting the encrypted message according to a decryption function; and the electric lock determining whether to perform an action according to a decryption result of the encrypted message.

According to an embodiment of the present invention, an electric lock includes a wireless module, a storage unit, a lock unit, and a processing unit. The processing unit is electrically connected to the wireless module, the storage unit and the lock unit. The electric lock is operated by using a portable device. The portable device obtains an encrypted message according to an encryption function, and the portable device transmits the encrypted message to the electric lock. The wireless module receives the encrypted message. The processing unit decrypts the encrypted message according to a decryption function, and the processing unit determines whether to perform an action according to a decryption result of the encrypted message.

According to the aforementioned embodiments, with the portable device transmitting the encrypted message to the electric lock and the electric lock decrypting the encrypted message, the present invention can prevent people with bad intentions from obtaining the default password by skimming or from cracking the default password by trying different permutation combination of buttons, which is favorable for enhancing the safety.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
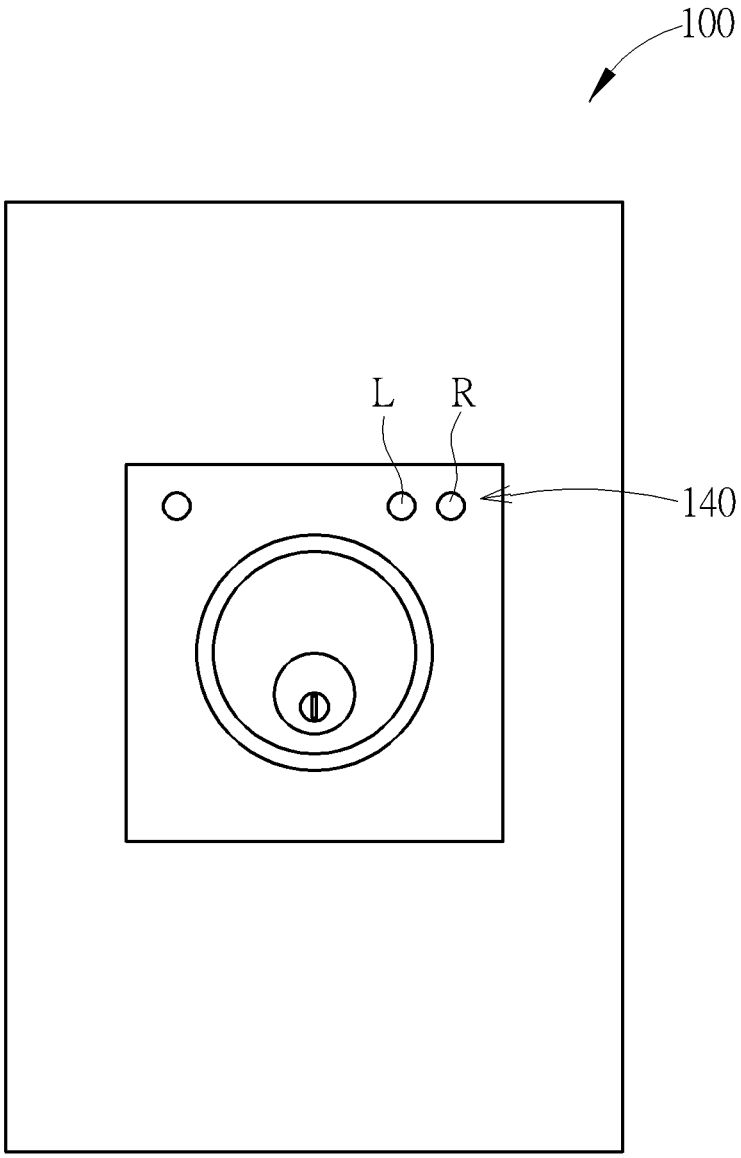
FIG. 1 is a schematic diagram of an electric lock of the present invention.
Figure 2:
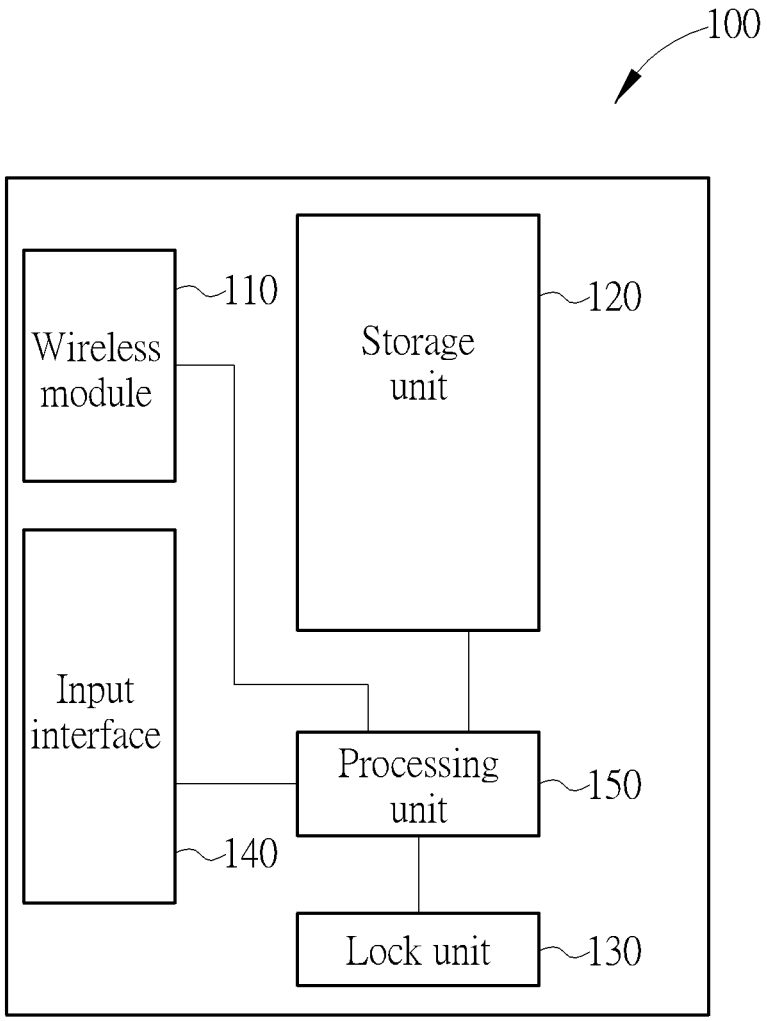
FIG. 2 is a functional block diagram of the electric lock of the present invention.

Please refer to FIG. 1 and FIG. 2. FIG. 1 is a schematic diagram of an electric lock 100 of the present invention.

FIG. 2 is a functional block diagram of the electric lock 100 of the present invention. As shown in FIG. 1 and FIG. 2, the electric lock 100 includes a wireless module 110, a storage unit 120, a lock unit 130 and a processing unit 150, wherein the electric lock 100 can selectively include an input interface 140. The wireless module 110 can be a Bluetooth module or other wireless communication modules. The storage unit 120 is configured to store data (such as a device unique identification information of the portable device, a unique code or a predetermined administrator password). The storage unit 120 can be, but is not limited to, a read-only memory (ROM), a random access memory (RAM) or a combination thereof. The lock unit 130 is configured to perform a locking operation or an unlocking operation for an object (such as a door). The lock unit 130 can be a conventional lock mechanism, which can include a lock tongue, a plate, a transmission mechanism (including a motor, a gear, etc.) and a clutch mechanism, wherein the clutch mechanism is coordinated with the plate to allow the transmission mechanism capable of driving the lock tongue so as to lock or unlock the door. The input interface 140 is configured to receive an external input. In the present embodiment, the input interface 140 includes a key L and a key R, but the present invention is not limited thereto. In other embodiments of the present invention, the input interface 140 can further include other input elements of different kinds, such as a numeric keypad or touch panel. The processing unit 150 is electrically connected to the wireless module 110, the storage unit 120, the lock unit 130 and the input interface 140, and configured to control operation of the electric lock 100. The processing unit 150 can be, but is not limited to, a central processing unit (CPU).

Figure 3:
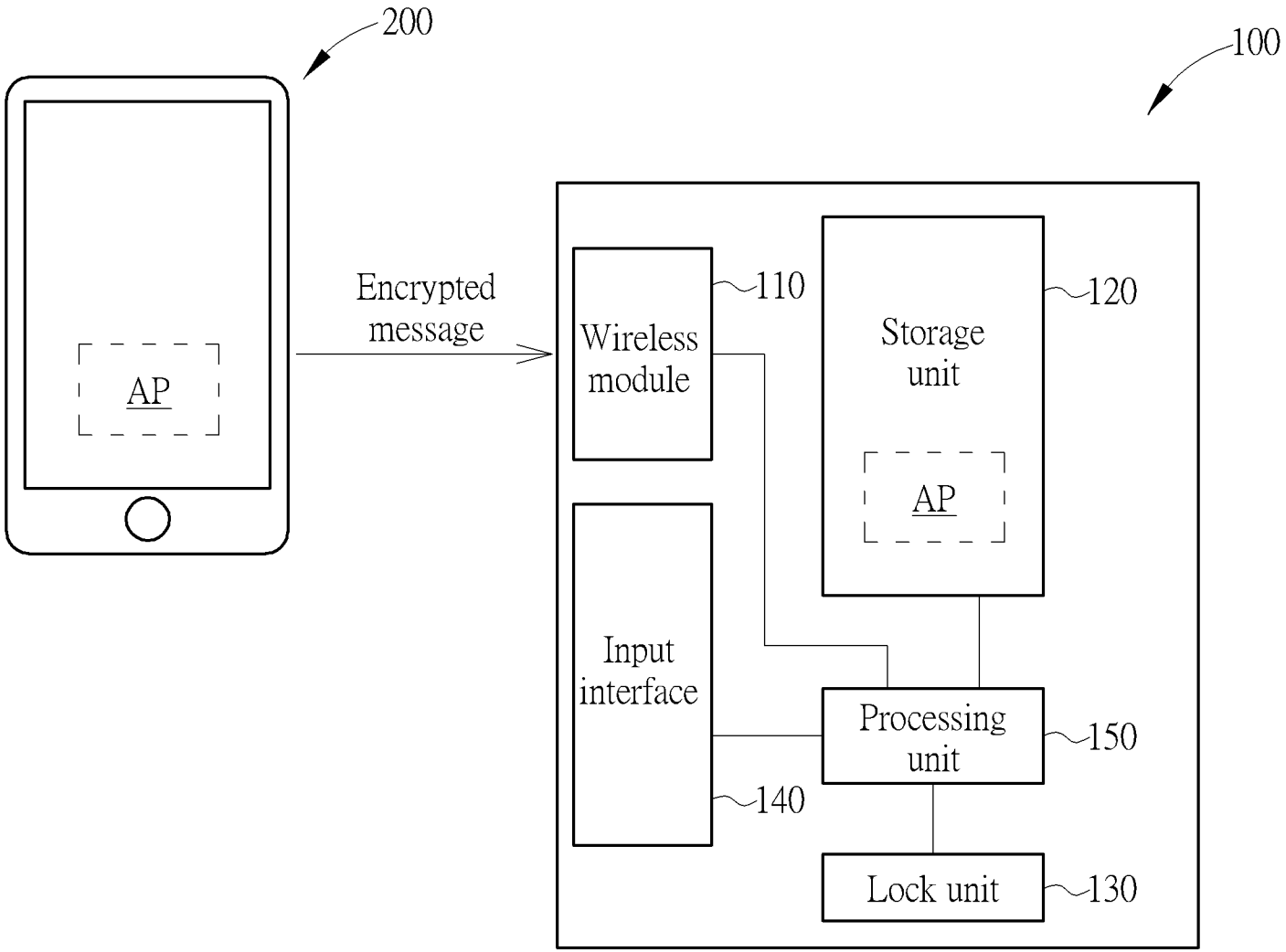
FIG. 3 is a schematic diagram illustrating the electric lock receiving an encrypted message according to an embodiment of the present invention.

Please refer to FIG. 3 as well as FIG. 1 and FIG. 2. FIG. 3 is a schematic diagram illustrating the electric lock 100 receiving an encrypted message according to an embodiment of the present invention. As shown in FIG. 3, the electric lock 100 can be operated by using a portable device 200. The portable device 200 obtains the encrypted message according to an encryption function, and transmits the encrypted message to the electric lock 100. The wireless module 110 of the electric lock 100 receives the encrypted message. The processing unit 150 decrypts the encrypted message according to a decryption function, and the processing unit 150 determines whether to perform an action according to a decryption result of the encrypted message. For example, each of the electric lock 100 and the portable device 200 can be installed with an application program AP, and the encryption function and the decryption function can be built in the application program AP. The portable device 200 can use the encryption function of the application program AP to encrypt a message (such as a time message, an unlock command, etc.) to obtain the encrypted message, then transmits the encrypted message to the electric lock 100. After the wireless module 110 of the electric lock 100 receiving the encrypted message, the electric lock 100 can use the decryption function of the application program AP to decrypt the encrypted message transmitted by the portable device 200. The encryption function and the decryption function can be based on, but is not limited to, an advanced encryption standard (AES) algorithm.

With the electric lock 100 is operated by the portable device 200, it can prevent people with bad intentions from obtaining the default password by peeping or from cracking the default password by trying different permutation combination of buttons, which is favorable for enhancing the safety. Furthermore, the communicating messages between the electric lock 100 and the portable device 200 are encrypted messages, which can prevent other portable device from wirelessly intercepting the communicating messages and performing an unlocking operation to the electric lock 100, so that the safety can be further enhanced.

Figure 4:
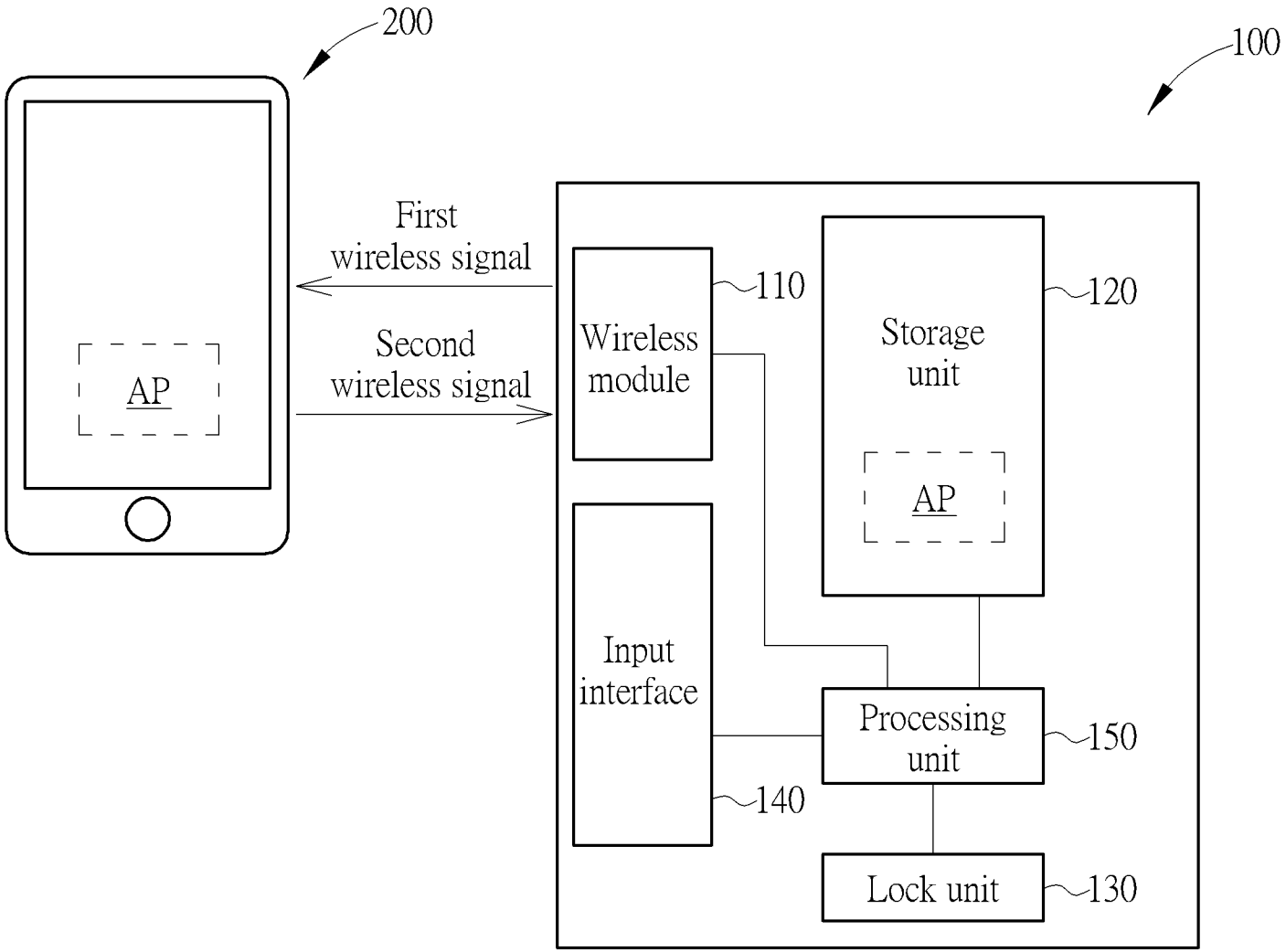
FIG. 4 is a schematic diagram illustrating the electric lock performing an unlocking operation according to a first example of FIG. 3.

Please refer to FIG. 4 as well as FIG. 1 to FIG. 3. FIG. 4 is a schematic diagram illustrating the electric lock 100 performing an unlocking operation according to a first example of FIG. 3. Specifically, the wireless module 110 can transmit a first wireless signal by broadcasting. The first wireless signal can include a lock unique identification information of the electric lock 100 and a time message. The lock unique identification information can be a universally unique identifier (UUID). The time message can be the time of a real-time clock (RTC) or a clock chip of the electric lock 100 when transmitting the first wireless signal. The portable device 200 can receive the first wireless signal by scanning and determine if the lock unique identification information of the first wireless signal matches a default lock unique identification information. The portable device 200 can encrypt the time message to obtain the encrypted message according to the encryption function when the lock unique identification information matches the default lock unique identification information. The portable device 200 can transmit a second wireless signal by broadcasting. The second wireless signal can include the encrypted message and a device unique identification information of the portable device 200. The device unique identification information can be a universally unique identifier (UUID). The wireless module 100 can receive the second wireless signal by scanning. The processing unit 150 can determine if the device unique identification information of the second wireless signal matches a default device unique identification information. The default device unique identification information is stored in the storage unit 120. The processing unit 150 decrypts the encrypted message to obtain the time message according to the decryption function when the device unique identification information matches the default device unique identification information. The processing unit 150 can determine whether to perform the unlocking operation according to the time message and a signal strength value of the second wireless signal received by the wireless module 110. The signal strength value can be a received signal strength indication (RSSI). Specifically, the processing unit 150 can control the lock unit 130 to perform the unlocking operation when the processing unit 150 determines that a difference between the time message and a time at which the wireless module 110 receives the second wireless signal is less than a time threshold value and the signal strength value is greater than a default strength value.

According to the above explanation, in the first example, the electric lock 100 and the portable device 200 communicate with each other by broadcasting and scanning. The step of requesting connection from the portable device 200 to the electric lock 100 can be omitted, which is favorable for saving time and enhancing the efficiency of unlocking operation. Furthermore, in the first example, the electric lock 100 determines if the portable device 200 is a default portable device for unlocking the electric lock 100 by the device unique identification information of the portable device 200, and the portable device 200 determines if the electric lock 100 is a default electric lock to be unlocked by the lock unique identification information of the electric lock 100. Therefore, it can prevent the electric lock 100 from being unlocked by a non-default portable device, which is favorable for enhancing the safety of the electric lock 100.

Moreover, in the first example, the electric lock 100 uses the time message being the encrypted message, which can ensure the uniqueness of the encrypted message, and can prevent the electric lock 100 being unlocked due to an error message. That is, in the first example, the processing unit 150 controls the lock unit 130 to perform the unlocking operation when the following two conditions are satisfied simultaneously. The first condition is that the difference between the time message of the first wireless signal and the time at which the wireless module 110 received the second wireless signal should be less than the time threshold value. The second condition is that the signal strength value of the second wireless signal should be greater than a default strength value. With the first condition, the timeliness of the second wireless signal can be enhanced, which can increase the difficult to crack the encrypted message. With the second condition, the precise timing for performing the unlocking operation can be well controlled, which means only when a distance between the portable device 200 and the electric lock 100 is within a predetermined distance range (when the distance between the portable device 200 and the electric lock 100 is reduced, the signal strength value of the second wireless signal is increased), the processing unit 150 controls the lock unit 130 to perform the unlocking operation. Furthermore, in the example, both of the first wireless signal and the second wireless signal do not include any unlock commands, which can greatly reduce the chance of malicious intrusion by others.

Figure 5:
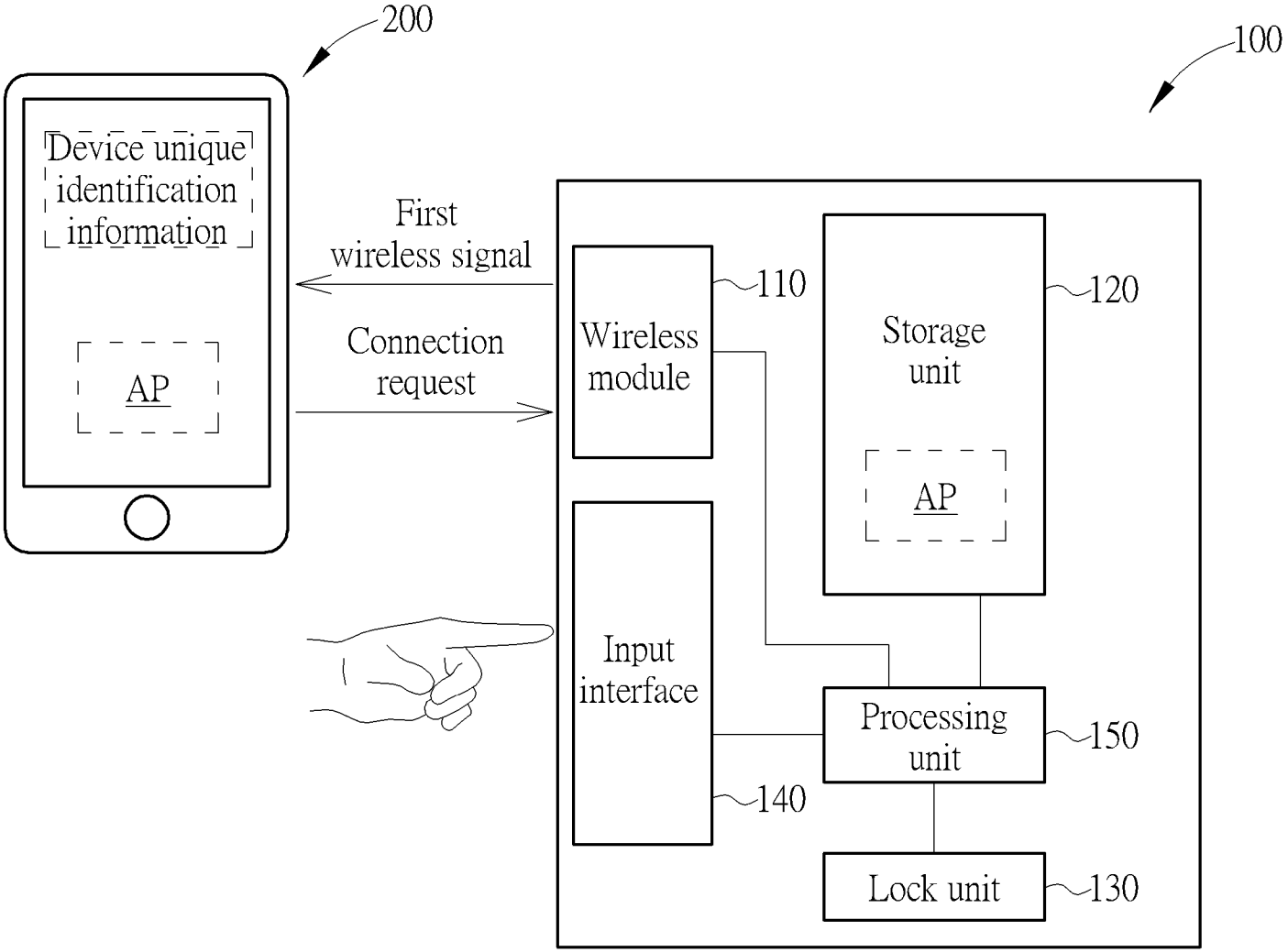
FIG. 5 is a schematic diagram illustrating the electric lock communicating with a portable device when performing the unlocking operation according to a second example of FIG. 3.

Please refer to FIG. 5 as well as FIG. 1 to FIG. 3. FIG. 5 is a schematic diagram illustrating the electric lock 100 communicating with the portable device 200 when performing the unlocking operation according to a second example of FIG. 3. In the second example, as mentioned in the related description of FIG. 3, the electric lock 100 can be operated by using the portable device 200. The portable device 200 obtains the encrypted message according to the encryption function, and transmits the encrypted message to the electric lock 100. The wireless module 110 of the electric lock 100 receives the encrypted message. The processing unit 150 decrypts the encrypted message according to the decryption function, and the processing unit 150 determines whether to perform an action according to the decryption result of the encrypted message. Other details of FIG. 3 can refer to above and are not repeated herein.

As shown in FIG. 1 and FIG. 5, the input interface 140 can be disposed on an outside of a door (not shown) for a user to input a unique code of the portable device 200. The unique code can be a permutation combination formed by the pressing sequence and the pressing times of the key L and the key R, such as LLRR, but the present invention is not limited thereto. The unique code can be set according to the type of the input interface 140, such as a numeric keypad or a touch panel. When the user desires to operate the electric lock 100 with the portable device 200, the user needs to input the unique code of the portable device 200 via the input interface 140. Then the processing unit 150 determines if the unique code matches a default code stored in the storage unit 120. The wireless module 110 transmits a first wireless signal when the unique code matches the default code. The first wireless signal includes a device unique identification information of the portable device 200. The portable device 200 having the device unique identification transmits a connection request after receiving the first wireless signal, so as to establish connection with the wireless module 110.

With the user requiring to manually input the unique code from an outside of the door, it can prevent the user from mistakenly performing the unlocking operation inside the door. Moreover, the portable device 200 which is defaulted to unlock the electric lock 100 has a unique code, it can prevent the electric lock 100 from being unlocked by a non-default portable device so as to enhance the safety of the electric lock 100.

Figure 6:
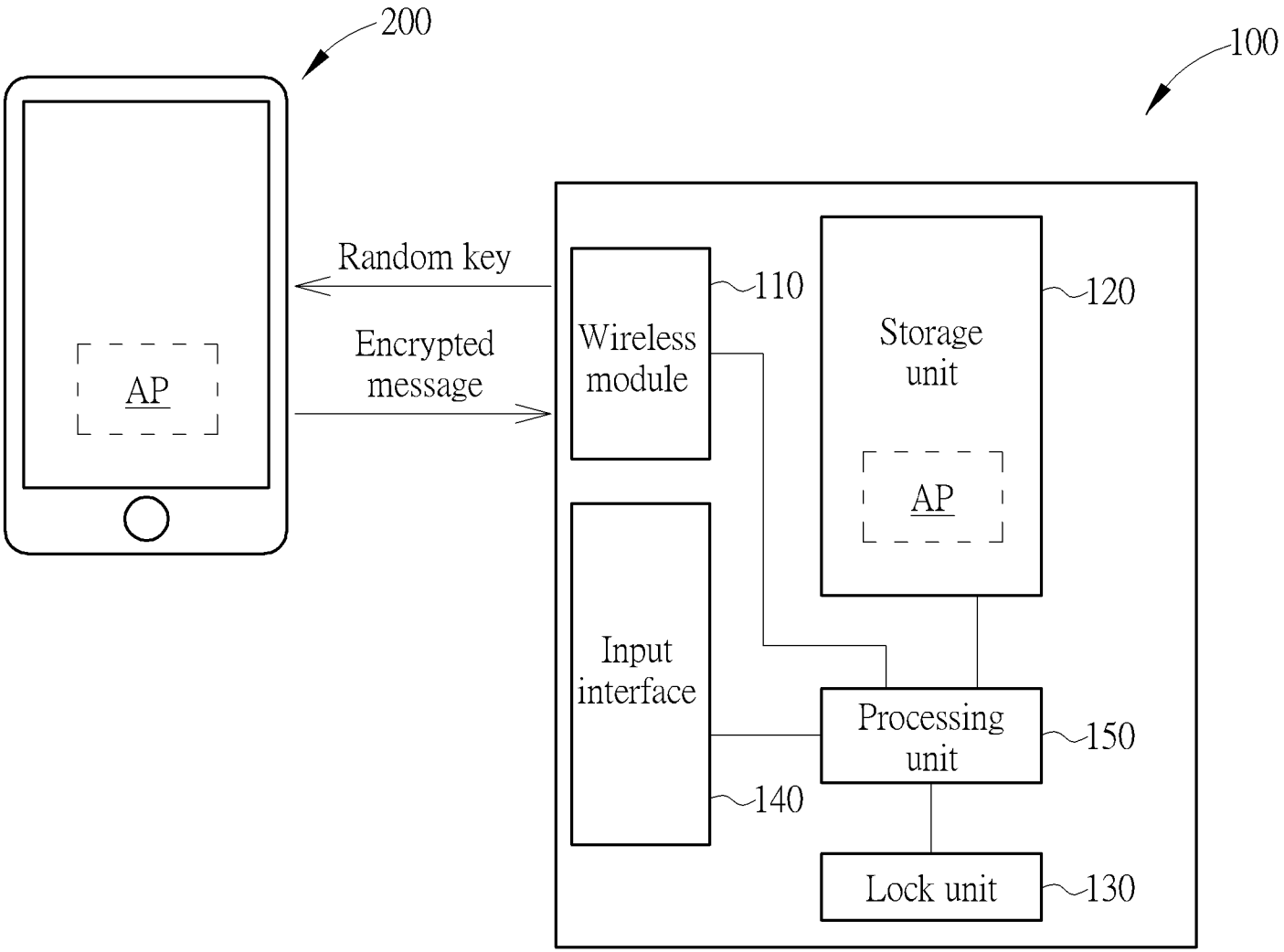
FIG. 6 is a schematic diagram illustrating the electric lock transmitting a random key and the portable device transmitting the encrypted message when performing the unlocking operation according to the second example of FIG. 3.

Please refer to FIG. 6. FIG. 6 is a schematic diagram illustrating the electric lock 100 transmitting a random key and the portable device 200 transmitting the encrypted message when performing the unlocking operation according to the second example of FIG. 3. After the portable device 200 establishes connection with the wireless module 110, the processing unit 150 generates a random key and transmits the random key to the portable device 200 via the wireless module 100. The portable device 200 can encrypt an action command with the random key according to the encryption function to obtain the encrypted message. The electric lock 100 can decrypt the encrypted message with the random key according to the decryption function. When the electric lock 100 successfully decrypts the encrypted message, the electric lock 100 performs an action assigned in the action command. Specifically, the random key can be generated by the application program AP installed in the electric lock 100. The communicating messages between the electric lock 100 and the portable device 200 can be encrypted and decrypted via the random key. The action command can be a unlock command. When the electric lock 100 successfully decrypts the encrypted message, the processing unit 150 of the electric lock 100 can control the lock unit 130 to perform the unlocking operation.

With using the random key to encrypt and decrypt, it can prevent other portable device from wirelessly intercepting the communicating messages and performing the unlocking operation to the electric lock 100, which can enhance the safety. Furthermore, the random key of each connection between the electric lock 100 and the portable device 200 can be different. It can prevent people with bad intentions from skimming and copying, so that the safety can be further enhanced.

Figure 7:
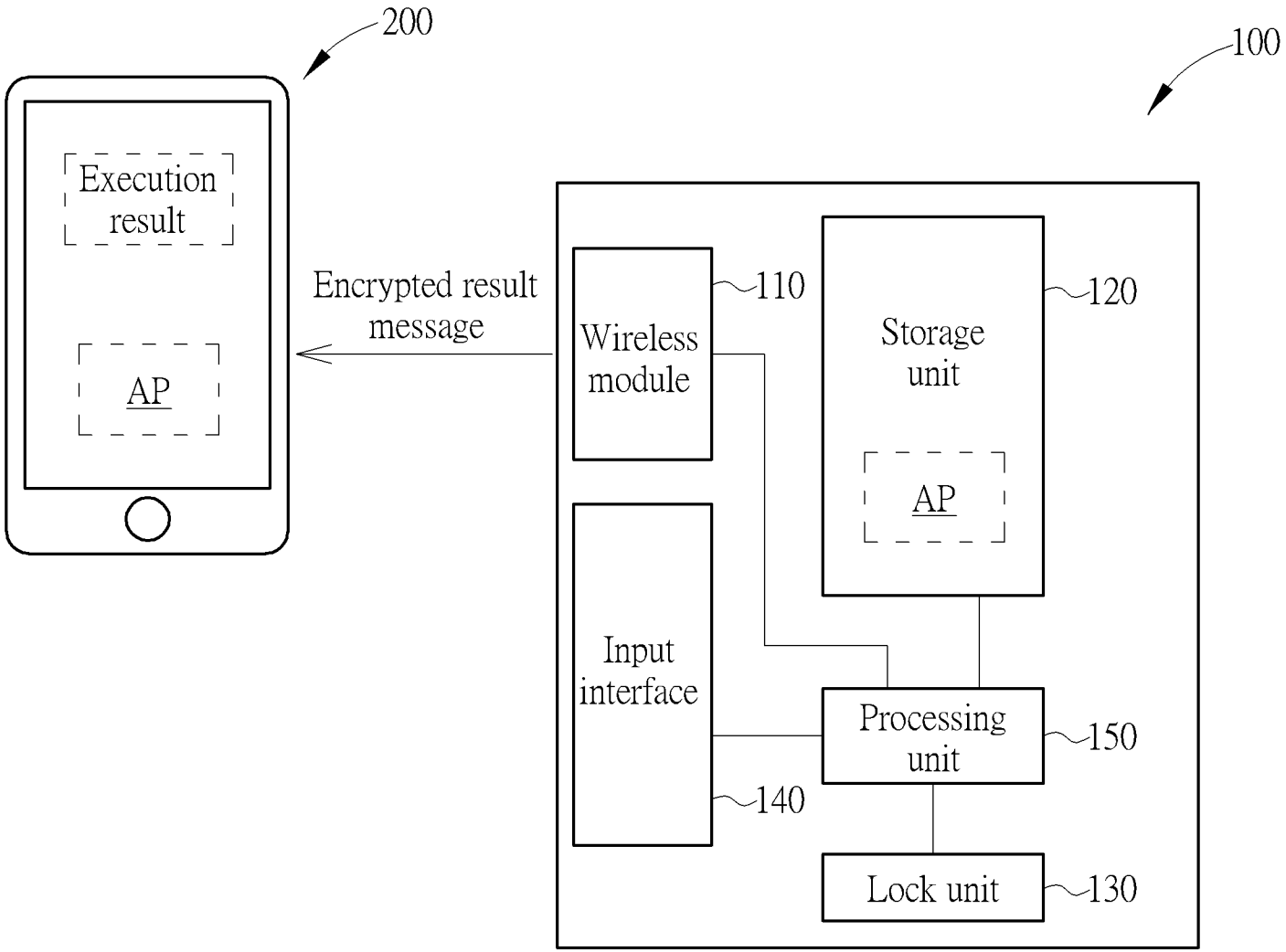
FIG. 7 is a schematic diagram illustrating the electric lock transmitting an encrypted result message when performing the unlocking operation according to the second example of FIG. 3.

Please refer to FIG. 7. FIG. 7 is a schematic diagram illustrating the electric lock 100 transmitting an encrypted result message when performing the unlocking operation according to the second example of FIG. 3. As shown in FIG. 7, after the electric lock 100 successfully decrypting the encrypted message and the electric lock 100 performing the action assigned in the action command, the processing unit 150 can encrypt an execution result of performing the action command with the random key according to the encryption function to obtain an encrypted result message, and control the wireless module 110 to transmit the encrypted result message to the portable device 200. The portable device 200 can decrypt the encrypted result message with the random key according to the decryption function to read the execution result. Therefore, the electric lock 100 can report to the portable device 200 whether the action command given by the portable device 200 is successfully performed. For example, when the action command is a unlock command, the electric lock 100 can report to the portable device 200 whether the electric lock 100 is successfully unlocked. Moreover, the portable device 200 can stored the execution result, so as to preserve the operation record of the electric lock 100.

According to the above explanation, in the second example, with the user requiring to manually input the unique code at an outside of the door, it can prevent the user from mistakenly performing the unlocking operation inside the door. Moreover, with the use of the random key, the safety of the electric lock 100 can be enhanced significantly.

Figure 8:
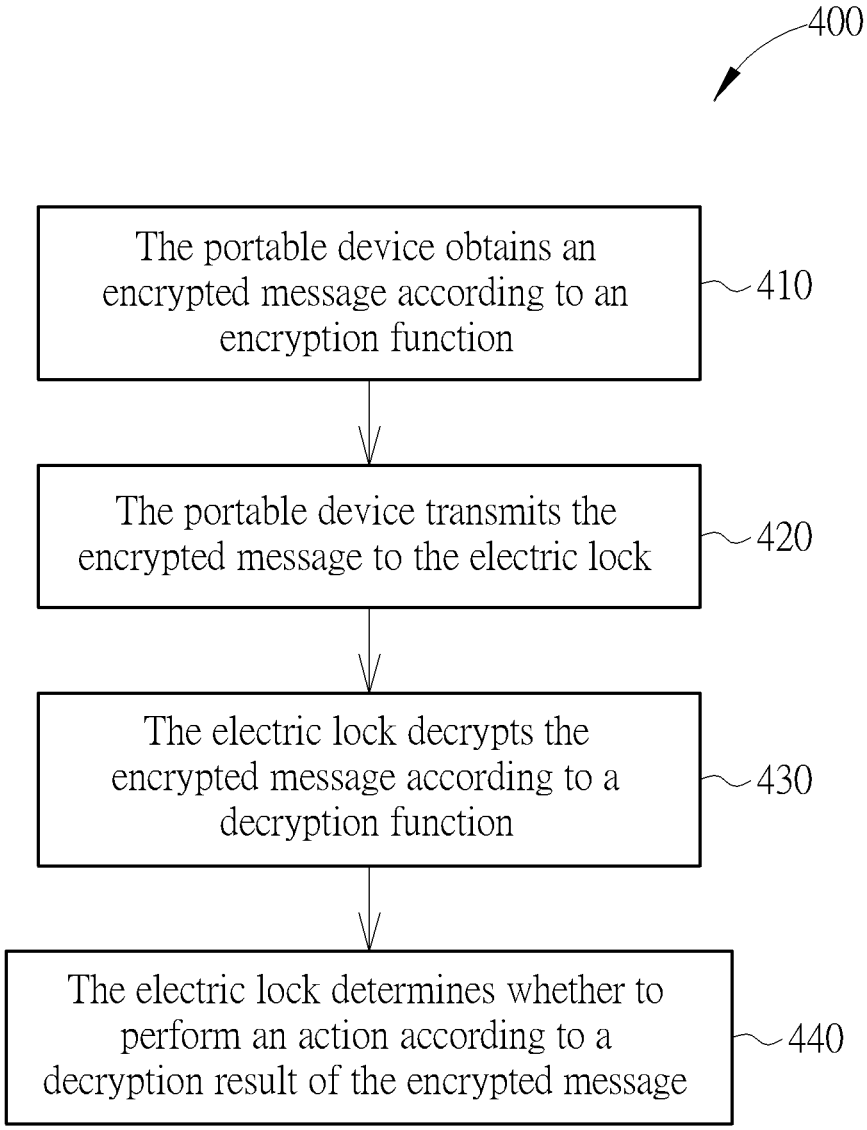
FIG. 8 is a flowchart illustrating a control method for operating the electric lock by using the portable device according to the present invention.

Please refer to FIG. 8. FIG. 8 is a flowchart illustrating a control method 400 for operating an electric lock by using a portable device according to the present invention. In FIG. 8, the control method 400 includes Step 410, Step 420, Step 430 and Step 440.

In Step 410, the portable device obtains an encrypted message according to an encryption function. In Step 420, the portable device transmits the encrypted message to the electric lock. In Step 430, the electric lock decrypts the encrypted message according to a decryption function. In Step 440, the electric lock determines whether to perform an action according to a decryption result of the encrypted message. Details of Step 410 to Step 440 can refer to the related description of FIG. 3 and are not repeated herein.

Figure 9:
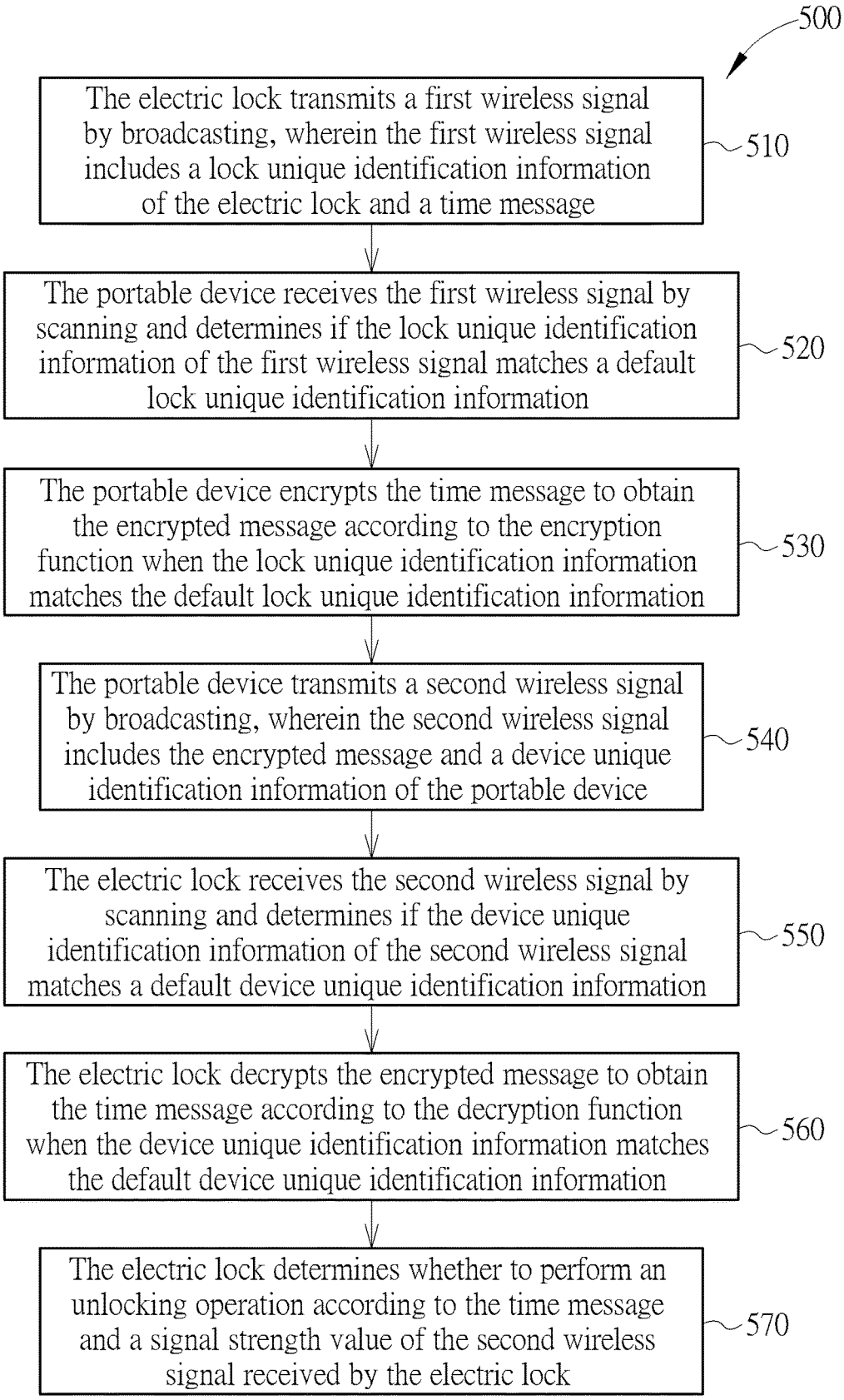
FIG. 9 is a flowchart illustrating a control method of a first example of FIG. 8.

Please refer to FIG. 9. FIG. 9 is a flowchart illustrating a control method 500 of a first example of FIG. 8. In FIG. 9, the control method 500 includes Step 510, Step 520, Step 530, Step 540, Step 550, Step 560 and Step 570.

In Step 510, the electric lock transmits a first wireless signal by broadcasting, wherein the first wireless signal includes a lock unique identification information of the electric lock and a time message.

In Step 520, the portable device receives the first wireless signal by scanning and determines if the lock unique identification information of the first wireless signal matches a default lock unique identification information.

In Step 530, the portable device encrypts the time message to obtain the encrypted message according to the encryption function when the lock unique identification information matches the default lock unique identification information.

In Step 540, the portable device transmits a second wireless signal by broadcasting, wherein the second wireless signal includes the encrypted message and a device unique identification information of the portable device.

In Step 550, the electric lock receives the second wireless signal by scanning and determines if the device unique identification information of the second wireless signal matches a default device unique identification information.

In Step 560, the electric lock decrypts the encrypted message to obtain the time message according to the decryption function when the device unique identification information matches the default device unique identification information.

In Step 570, the electric lock determines whether to perform an unlocking operation according to the time message and a signal strength value of the second wireless signal received by the electric lock.

Details of Step 510 to Step 570 can refer to the related description of FIG. 4 and are not repeated herein.

Figure 10:
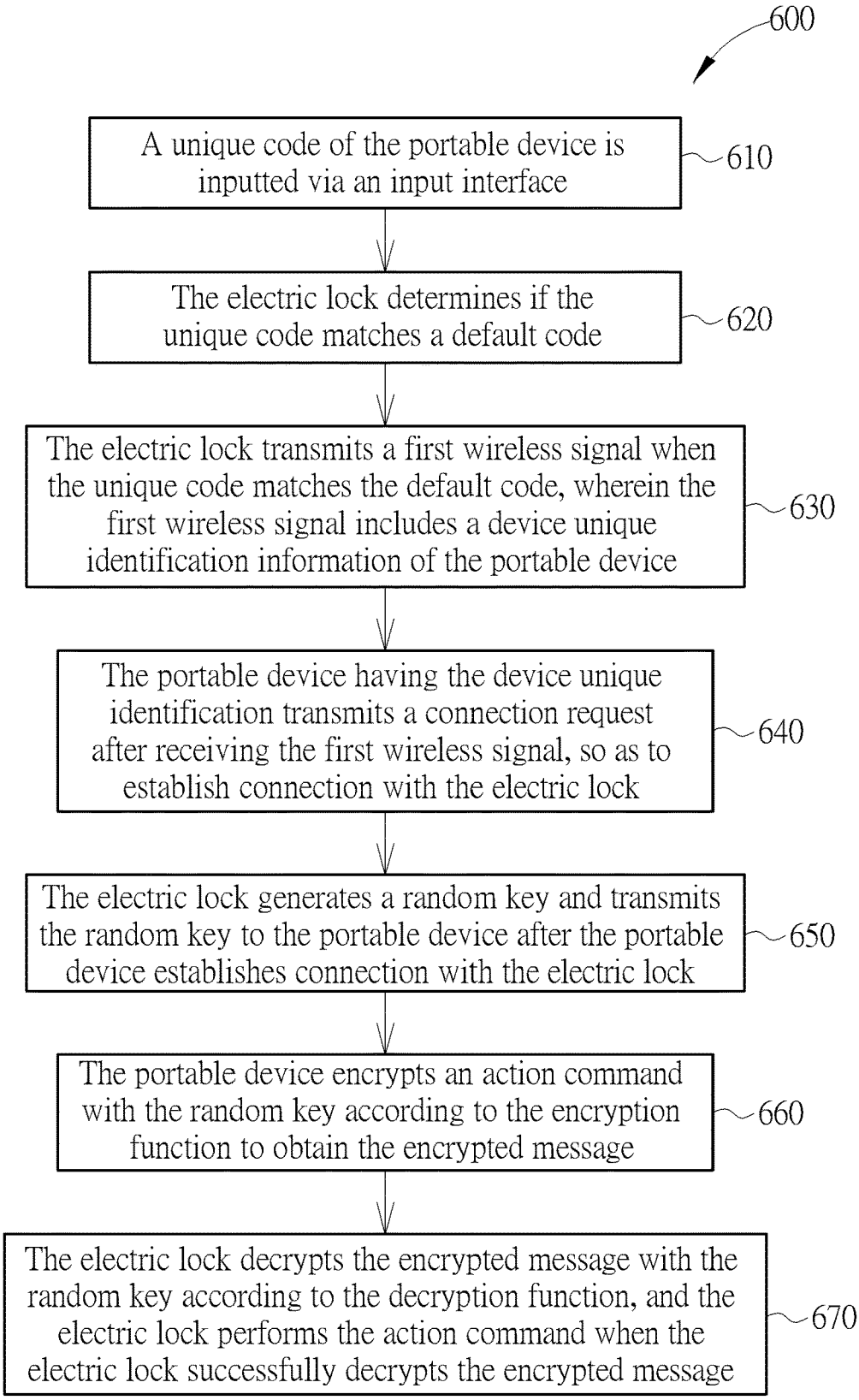
FIG. 10 is a flowchart illustrating a control method of a second example of FIG. 8.

FIG. 10 is a flowchart illustrating a control method 600 of a second example of FIG. 8. In FIG. 10, the control method 600 includes Step 610, Step 620, Step 630, Step 640, Step 650, Step 660 and Step 670.

In Step 610, a unique code of the portable device is inputted via an input interface.

In Step 620, the electric lock determines if the unique code matches a default code.

In Step 630, the electric lock transmits a first wireless signal when the unique code matches the default code, wherein the first wireless signal includes a device unique identification information of the portable device.

In Step 640, the portable device having the device unique identification transmits a connection request after receiving the first wireless signal, so as to establish connection with the electric lock.

In Step 650, the electric lock generates a random key and transmits the random key to the portable device after the portable device establishes connection with the electric lock.

In Step 660, the portable device encrypts an action command with the random key according to the encryption function to obtain the encrypted message.

In Step 670, the electric lock decrypts the encrypted message with the random key according to the decryption function, and the electric lock performs the action command when the electric lock successfully decrypts the encrypted message.

Details of Step 610 to Step 670 can refer to the related description of FIG. 5 to FIG. 7 and are not repeated herein.

Figure 11:
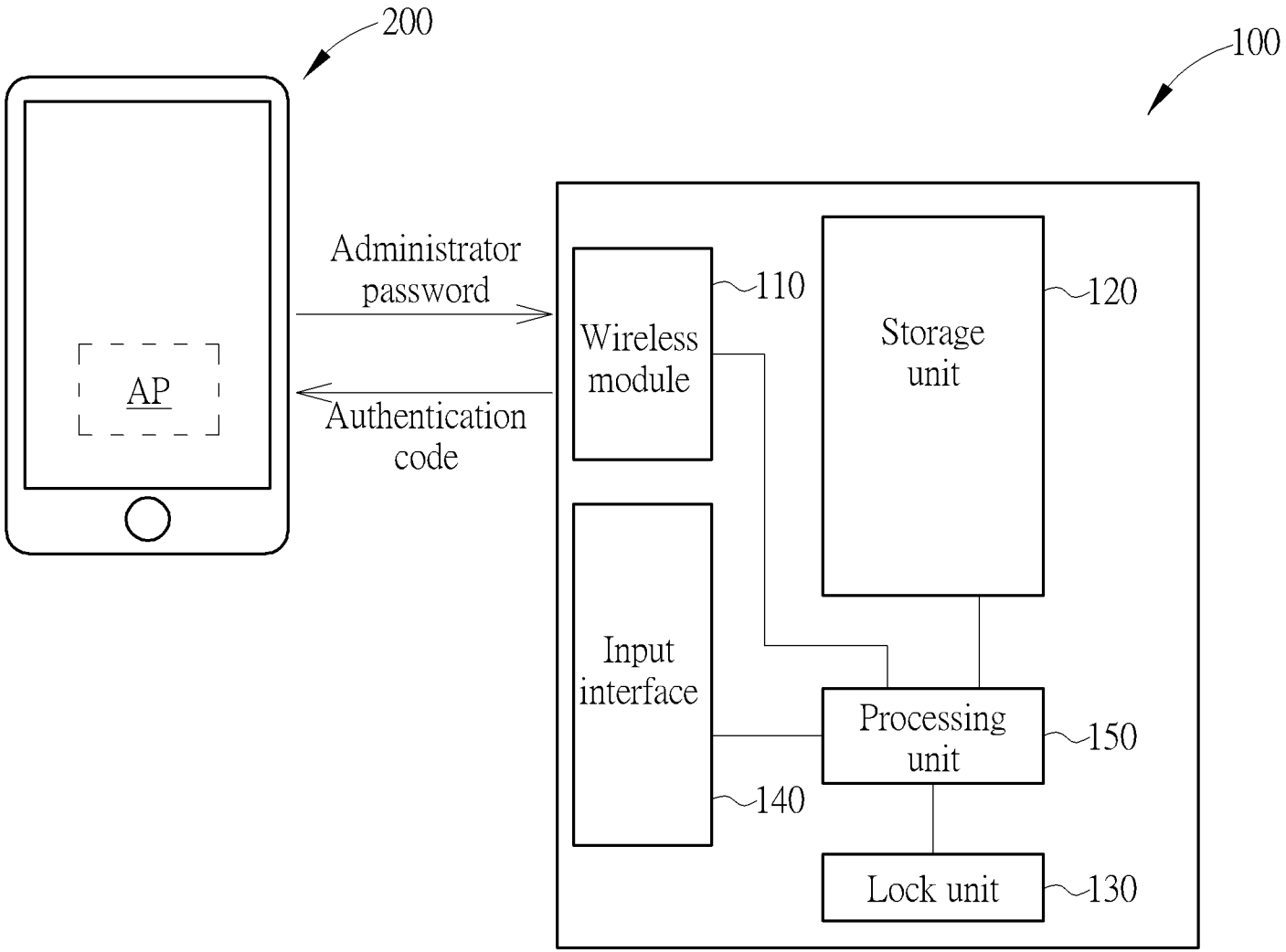
FIG. 11 is a schematic diagram illustrating the electric lock entering an administrator setting mode according to another embodiment of the present invention.

Please refer to FIG. 11 as well as FIG. 1 and FIG. 2. FIG. 11 is a schematic diagram illustrating the electric lock 100 entering an administrator setting mode according to another embodiment of the present invention. As shown in figures, a portable device 200 is operated to communicate with the electric lock 100 by an administrator. For example, the portable device 200 is installed with an application program AP and communicates with the electric lock 100 through the wireless module 110 of the electric lock 100. The administrator is able to input an administrator password to the application program AP, and the portable device 200 is utilized for transmitting the administrator password to electric lock 100. When the processing unit 150 determines that the administrator password transmitted from the portable device 200 matches the predetermined administrator password stored in the storage unit 120, the processing unit 150 enters an administrator setting mode. On the other hand, regardless of whether the administrator password is inputted from an authenticated/a paired portable device, or even the administrator password is inputted from an unspecified portable device, the processing unit 150 is able to enter the administrator setting mode as long as the processing unit 150 determines that the inputted administrator password matches the predetermined administrator password, such that the electric lock 100 is convenient in management and reduces issues resulting from loss of the portable device. In the administrator setting mode, the administrator is able to utilize the portable device 200 for controlling the processing unit 150 to randomly generate an authentication code (or a plurality of authentication codes). The number of the authentication codes can depend on the administrator's demands. After the authentication code is generated by the processing unit 150, the processing unit 150 is able to control the wireless module 110 to transmit the authentication code to the portable device 200. In addition, the processing unit 150 is further able to control the storage unit 120 to store the authentication code.

Figure 12:
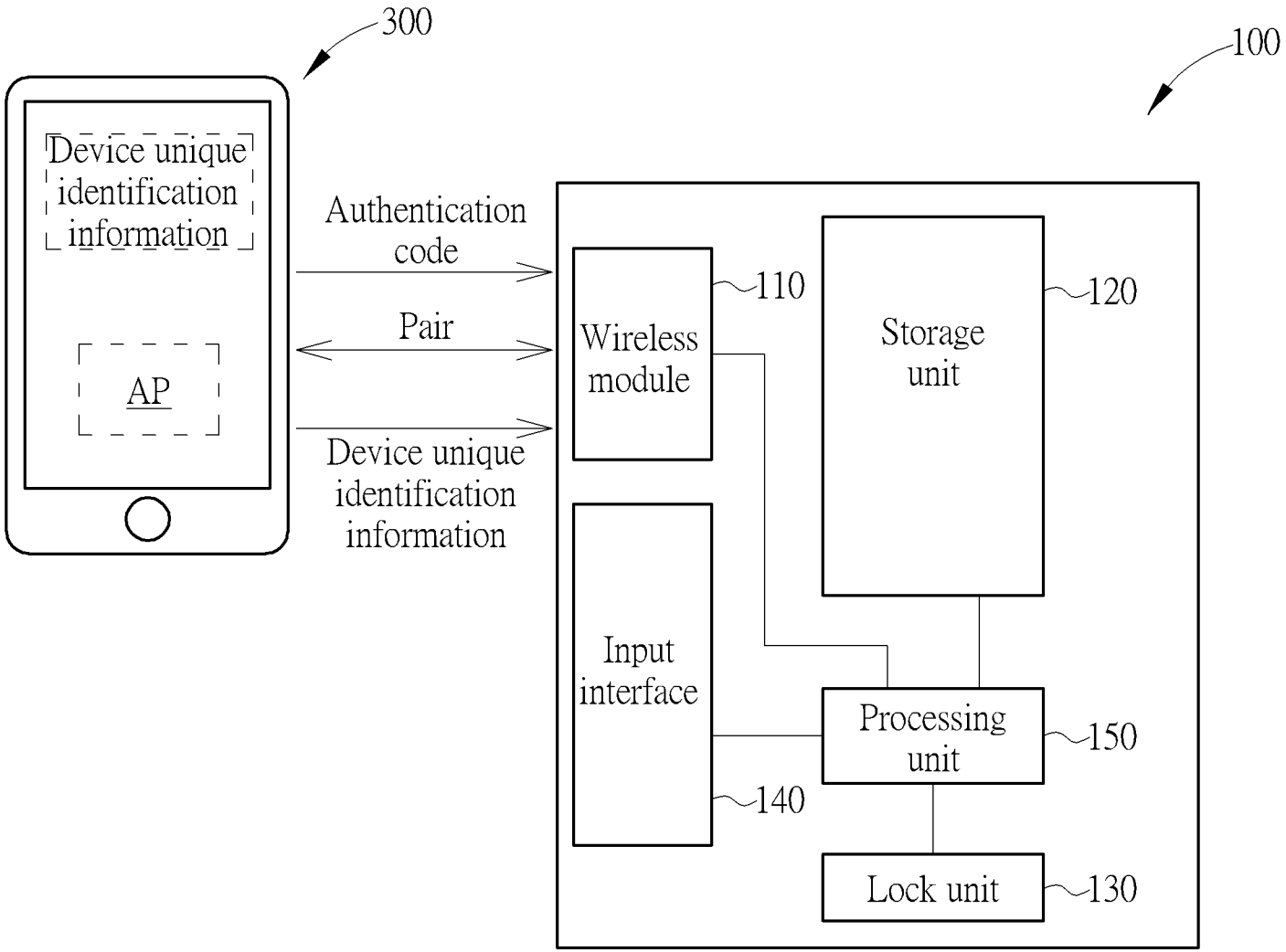
FIG. 12 is a schematic diagram illustrating the electric lock of FIG. 11 entering a user setting mode.

Please refer to FIG. 12 as well as FIG. 1 and FIG. 2. FIG. 12 is a schematic diagram illustrating the electric lock 100 of FIG. 11 entering a user setting mode. When the authentication code is received, the administrator is able to notify a temporary user of the authentication code by SMS or by e-mail. Afterwards, the temporary user is able to set up an unlock setting based on the authentication code. As shown in FIG. 12, a portable device 300 is operated to communicate with the electric lock 100 by the temporary user. For example, the portable device 300 is installed with the application program AP and is able to communicate with the electric lock 100 through the wireless module 110 of the electric lock 100. The temporary user is able to input the authentication code to the application program AP, the portable device 300 is utilized for transmitting the authentication code to the electric lock 100, such that the processing unit 150 is able to compare the authentication code transmitted from the portable device 300 with the authentication code stored in the storage unit 120. When the processing unit 150 determines that the authentication code transmitted from the portable device 300 matches the authentication code stored in the storage unit 120, the processing unit 150 controls the wireless module 110 to be paired with the portable device 300 (e.g., in a Bluetooth paring manner) and receives a device unique identification information of the portable device 300. The device unique identification information of the portable device 300 can include at least one of a serial number of device, an international mobile equipment identity (IMEI) and a media access control (MAC) address. In addition, the processing unit 150 is further able to control the storage unit 120 to store the device unique identification information of the portable device 300.

Figure 13:
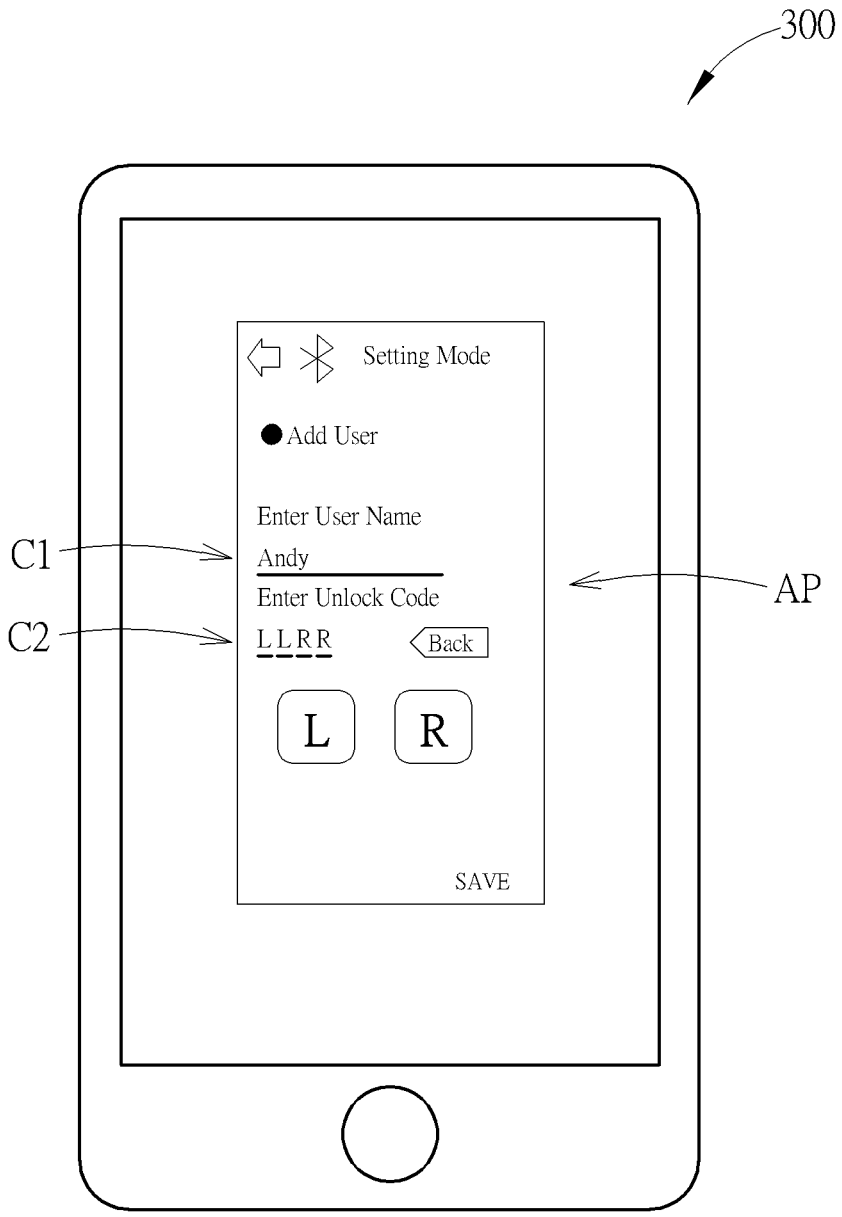
FIG. 13 is a schematic diagram illustrating the portable device of FIG. 11 in the user setting mode.

On the other hand, when the processing unit 150 determines that the authentication code transmitted from the portable device 300 matches the authentication code stored in the storage unit 120, the processing unit 150 is able to enter a user setting mode. As shown in FIG. 13, in the user setting mode, the temporary user is able to respectively input a user name and an unlock code in a user name column C1 and an unlock code column C2 of the application program AP. The unlock code is a sequence of the key L and the key R required for unlocking the electric lock 100, such as the sequence of LLRR, but the present invention is not limited thereto. The sequence can be set up according to the temporary user personal preferences. In addition, the unlock code is not limited to the sequence of pressing the key L and the key R. When the input interface 140 includes a numeric keypad or a touch panel in other embodiment, the unlock code can be the sequence of pressing the numeric keys or a gesture of touching and dragging. Afterwards, the application program AP transmits the user name and the unlock code inputted by the temporary user to the electric lock 100. When the processing unit 150 receives the user name and the unlock code in the user setting mode, the processing unit 150 is able to control the storage unit 120 to store the user name and the unlock code. In addition, in the user setting mode, the processing unit 150 does not generate the authentication code for avoiding the authority of the temporary user from over expansion. Moreover, when the authentication code is inputted, the processing unit 150 is able to tag the authentication code which has been inputted, so as to prevent the authentication codes from being used repeatedly.

Figure 14:
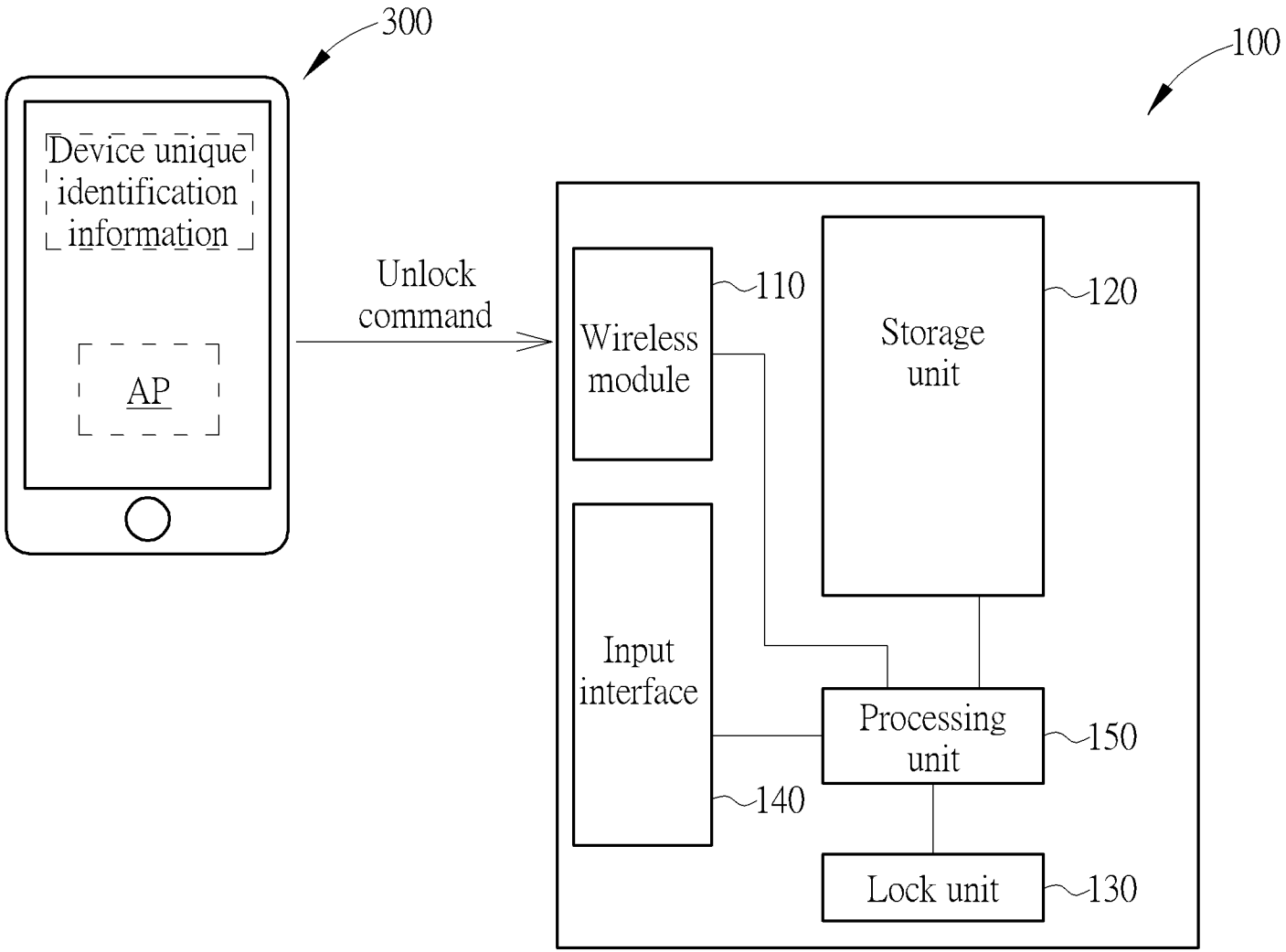
FIG. 14 is a schematic diagram illustrating the electric lock performing the unlocking operation according to a first example of FIG. 11.

Please refer to FIG. 14. FIG. 14 is a schematic diagram illustrating the electric lock 100 performing the unlocking operation according to a first example of FIG. 11. As shown in FIG. 14, when the temporary user desires to unlock the electric lock 100, the portable device 300 is utilized for transmitting a unlock command to the electric lock 100 through the application program AP by the temporary user. When the processing unit 150 receives the unlock command and the wireless module 110 senses the portable device 300 having the device unique identification information within a predetermined distance, the processing unit 150 is able to control the lock unit 130 to perform the unlocking operation.

Figure 15:
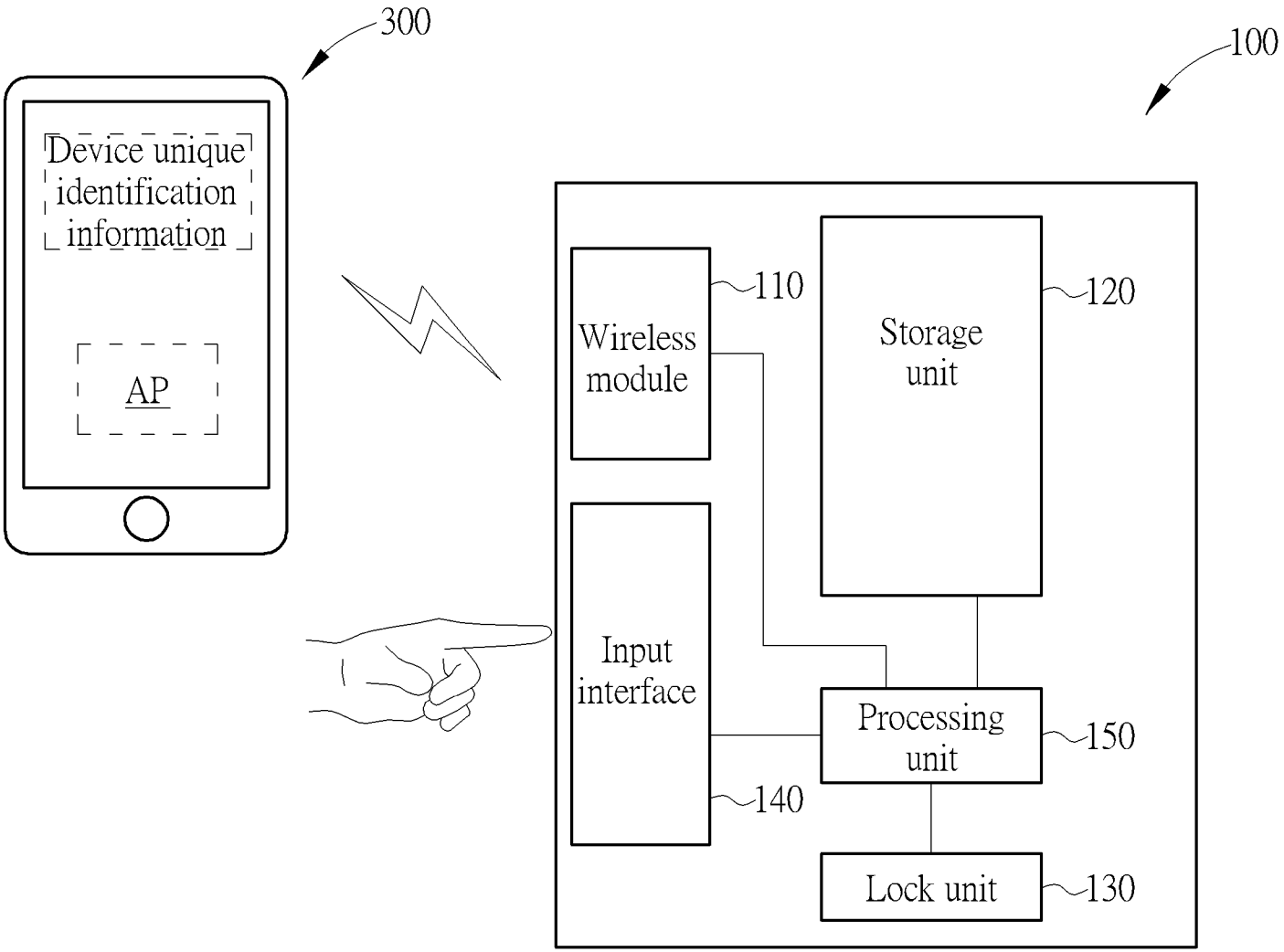
FIG. 15 is a schematic diagram illustrating the electric lock performing the unlocking operation according to a second example of FIG. 11.

On the other hand, referring to FIG. 15, FIG. 15 is a schematic diagram illustrating the electric lock 100 performing the unlocking operation according to a second example of FIG. 11. As shown in FIG. 15, when the temporary user desires to unlock the electric lock 100, the temporary user can press the key L and key R of the input interface 140 according the sequence of the unlock code set in advance. When the processing unit 150 determines that the sequence of the key L and the key R matches one of the unlock code stored in the storage unit 120 and when the wireless module 110 senses the portable device 300 having the device unique identification information (corresponding to the inputted unlock code) within a predetermined distance, the processing unit 150 is able to control the lock unit 130 to perform the unlocking operation. As such, the temporary user is able to unlock the electric lock 100 without operation of the portable device 300.

According to the above arrangement, the administrator of the electric lock 100 of the present invention can authorize the temporary user to set up the unlock setting, without changing the password by the operation of the electric lock 100 in person. In addition, after the temporary user finishes the unlock setting, the electric lock 100 is able to perform the unlocking operation through the portable device 300 having the device unique identification information. Since the device unique identification information of the portable device 300 is unique, it is difficult to crack the unlock setting set by the temporary user.

In addition, in the administrator setting mode, the administrator is able to further set a valid period corresponding to the authentication code through the application program AP of the portable device 200. When the temporary user desires to utilize the portable device 300 to unlock the electric lock 100 over expiration of the valid period, the processing unit 150 does not control the lock unit 130 to perform the unlocking operation according to the device unique identification information of the portable device 300.

Moreover, in the administrator setting mode, the administrator is able to further set a limit of usage count corresponding to the authentication code through the application program AP of the portable device 200. When a number of times of the portable device 300 used by the temporary user for unlocking the electric lock 100 exceeds the limit of usage count, the processing unit 150 does not control the lock unit 130 to perform the unlocking operation according to the device unique identification information of the portable device 300.

On the other hand, when processing unit 150 controls the lock unit 130 to perform the unlocking operation, the processing unit 150 can further control the storage unit 120 to store the user name and an unlock time slot of the portable device 300. The administrator is able to access an unlocked history of the electric lock 100 by means of connection between the portable device 200 and the electric lock 100. Alternatively, the processing unit 150 can upload the unlocked history of the electric lock 100 to a cloud server, such that the administrator is able to monitor the unlocked history of the electric lock 100 easily.

In the present embodiment, the portable device 200 of the administrator is different from the portable device 300 of the temporary user, but the present invention is not limited thereto. In other embodiments, the portable device 200 of the administrator can be the same as the portable device 300 of the temporary user.

Figure 16:
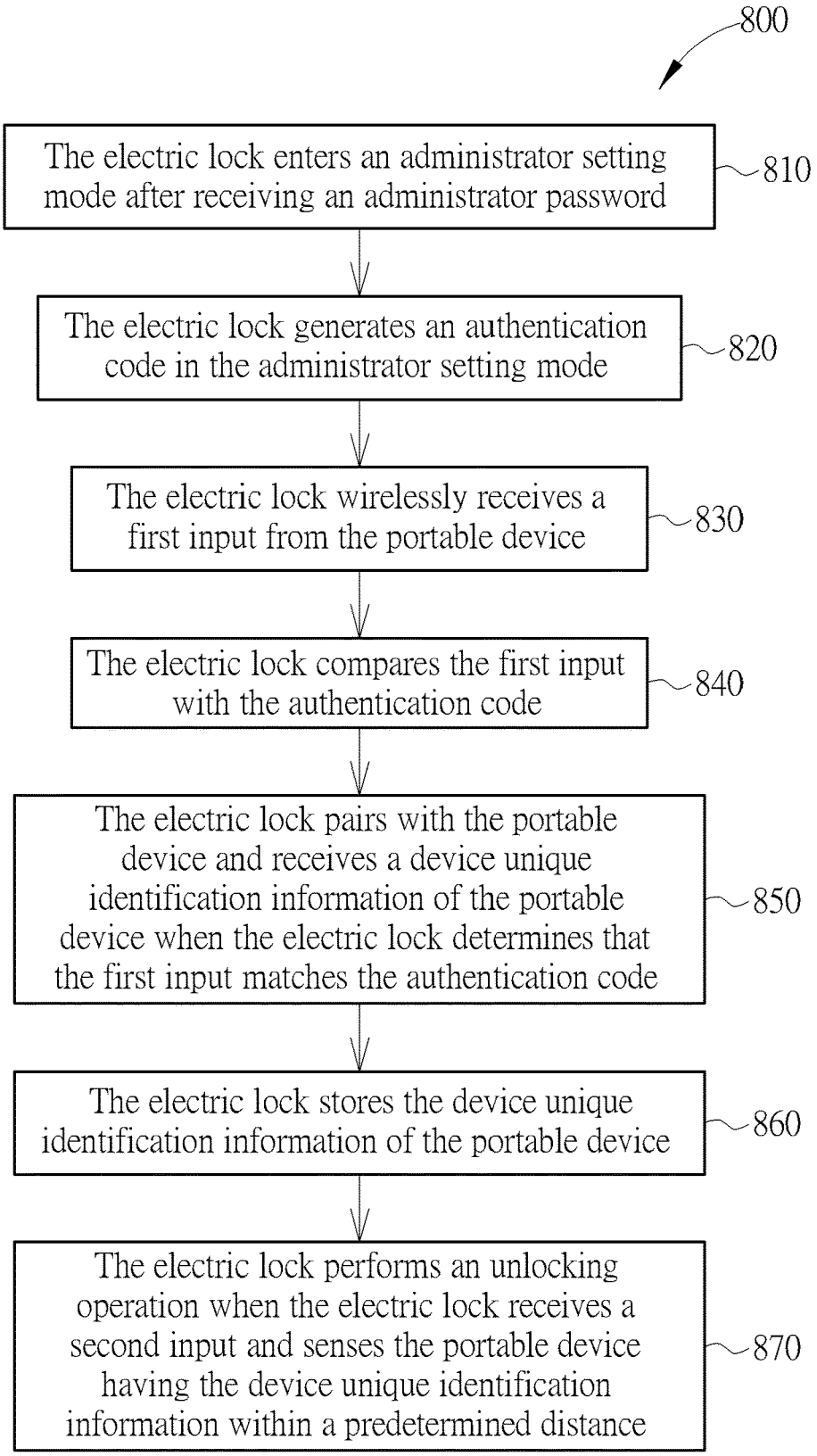
FIG. 16 is another flowchart illustrating a control method for operating the electric lock by using the portable device according to the present invention.

Please refer to FIG. 16. FIG. 16 is another flowchart illustrating a control method 800 for operating an electric lock by using a portable device according to the present invention. As shown in FIG. 16, the control method 800 includes Step 810, Step 8620, Step 830, Step 840, Step 850, Step 860 and Step 870.

In Step 810, the electric lock enters an administrator setting mode after receiving an administrator password.

In Step 820, the electric lock generates an authentication code in the administrator setting mode.

In Step 830, the electric lock wirelessly receives a first input from the portable device.

In Step 840, the electric lock compares the first input with the authentication code.

In Step 850, the electric lock pairs with the portable device and receives a device unique identification information of the portable device when the electric lock determines that the first input matches the authentication code.

In Step 860, the electric lock stores the device unique identification information of the portable device.

In Step 870, the electric lock performs an unlocking operation when the electric lock receives a second input and senses the portable device having the device unique identification information within a predetermined distance.

On the other hand, the order of the control method of the present invention is not limited to the order of the above steps. The order of the above steps can be changed. Moreover, the steps of the control method of the present invention need not be in the exact order shown.

In contrast to the prior art, with the portable device transmitting the encrypted message to the electric lock and the electric lock decrypting the encrypted message, the present invention can prevent people with bad intentions from obtaining the default password by skimming or from cracking the default password by trying different permutation combination of buttons, which is favorable for enhancing the safety.

In contrast to the prior art, an administrator of the electric lock of the present invention is able to authorize to a temporary user to set up an unlock setting, such that the administrator does not have to change password of the electric lock by operation of the electric lock in person, in order to improve convenience of management of the electric lock. In addition, the electric lock of the present invention performs the unlocking operation according to the device unique identification information of the portable device, in order to improve security of usage of the temporary user.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A control method for operating an electric lock by using a portable device, the control method comprising:

the electric lock transmitting a first wireless signal by broadcasting, wherein the first wireless signal comprises a lock unique identification information of the electric lock and a time message;

the portable device receiving the first wireless signal by scanning and determining if the lock unique identification information of the first wireless signal matches a default lock unique identification information;

the portable device encrypting the time message to obtain an encrypted message according to an encryption function when the lock unique identification information matches the default lock unique identification information;

the portable device transmitting a second wireless signal to the electric lock by broadcasting, wherein the second wireless signal comprises the encrypted message and a device unique identification information of the portable device;

the electric lock decrypting the encrypted message according to a decryption function; and the electric lock determining whether to perform an unlocking operation according to a decryption result of the encrypted message.

2. The control method of claim 1, wherein:

the electric lock receives the second wireless signal by scanning and determines if the device unique identification information of the second wireless signal matches a default device unique identification information;

the electric lock decrypts the encrypted message to obtain the time message according to the decryption function when the device unique identification information matches the default device unique identification information; and the electric lock determines whether to perform the unlocking operation according to the time message and a signal strength value of the second wireless signal received by the electric lock.

3. The control method of claim 2, wherein the electric lock performs the unlocking operation when the electric lock determines that a difference between the time message and a time at which the electric lock receives the second wireless signal is less than a time threshold value and the signal strength value is greater than a default strength value.

4. The control method of claim 2, wherein the signal strength value is a received signal strength indication (RSSI).

5. The control method of claim 1, wherein each of the lock unique identification information and the device unique identification information is a universally unique identifier (UUID).

6. A control method for operating an electric lock by using a portable device, the electric lock comprising an input interface disposed on an outside of a door, and the control method comprising further comprises:

inputting a unique code of the portable device via the input interface;

the electric lock determining if the unique code matches a default code;

the electric lock transmitting a first wireless signal when the unique code matches the default code, wherein the first wireless signal comprises a device unique identification information of the portable device;

the portable device having the device unique identification transmitting a connection request after receiving the first wireless signal, so as to establish connection with the electric lock;

the portable device obtaining an encrypted message according to an encryption function;

the portable device transmitting the encrypted message to the electric lock;

the electric lock decrypting the encrypted message according to a decryption function; and the electric lock determining whether to perform an action according to a decryption result of the encrypted message.

7. The control method of claim 6, further comprising:

the electric lock generating a random key and transmitting the random key to the portable device after the portable device establishes the connection with the electric lock;

the portable device encrypting an action command with the random key according to the encryption function to obtain the encrypted message; and the electric lock decrypting the encrypted message with the random key according to the decryption function, and the electric lock performing the action command when the electric lock successfully decrypts the encrypted message.

8. The control method of claim 7, further comprising:

the electric lock encrypting an execution result of performing the action command with the random key according to the encryption function to obtain an encrypted result message; and the electric lock transmitting the encrypted result message to the portable device.

9. The control method of claim 8, further comprising:

the portable device decrypting the encrypted result message with the random key according to the decryption function to read the execution result.

10. An electric lock, comprising:

a wireless module;

a storage unit;

a lock unit; and a processing unit electrically connected to the wireless module, the storage unit and the lock unit;

wherein the electric lock is operated by using a portable device;

wherein the wireless module transmits a first wireless signal by broadcasting, and the first wireless signal comprises a lock unique identification information of the electric lock and a time message;

wherein the portable device receives the first wireless signal by scanning and determines if the lock unique identification information of the first wireless signal matches a default lock unique identification information;

wherein the portable device encrypts the time message to obtain an encrypted message according to an encryption function when the lock unique identification information matches the default lock unique identification information, the portable device transmits a second wireless signal to the electric lock by broadcasting, and the second wireless signal comprises the encrypted message and a device unique identification information of the portable device;

wherein the wireless module receives the encrypted message, the processing unit decrypts the encrypted message according to a decryption function, and the processing unit determines whether to perform an unlocking operation according to a decryption result of the encrypted message.

11. The electric lock of claim 10, wherein the wireless module receives the second wireless signal by scanning and determines if the device unique identification information of the second wireless signal matches a default device unique identification information, the default device unique identification information is stored in the storage unit, the processing unit decrypts the encrypted message to obtain the time message according to the decryption function when the device unique identification information matches the default device unique identification information, and the processing unit determines whether to perform the unlocking operation according to the time message and a signal strength value of the second wireless signal received by the wireless module.

12. The electric lock of claim 11, wherein the processing unit controls the lock unit to perform the unlocking operation when the processing unit determines that a difference between the time message and a time at which the wireless module receives the second wireless signal is less than a time threshold value and the signal strength value is greater than a default strength value.

13. The electric lock of claim 11, wherein the signal strength value is a received signal strength indication (RSSI).

14. An electric lock, comprising:

a wireless module;

a storage unit;

a lock unit; and a processing unit electrically connected to the wireless module, the storage unit and the lock unit;

an input interface electrically connected to the processing unit, the input interface being disposed on an outside of a door for a user to input a unique code of a portable device;

wherein the processing unit determines if the unique code matches a default code stored in the storage unit;

wherein the wireless module transmits a first wireless signal when the unique code matches the default code, and the first wireless signal comprises a device unique identification information of the portable device;

wherein the portable device having the device unique identification transmits a connection request after receiving the first wireless signal, so as to establish connection with the wireless module;

wherein the electric lock is operated by using the portable device, the portable device obtains an encrypted message according to an encryption function, and the portable device transmits the encrypted message to the electric lock;

wherein the wireless module receives the encrypted message, the processing unit decrypts the encrypted message according to a decryption function, and the processing unit determines whether to perform an action according to a decryption result of the encrypted message.

15. The electric lock of claim 14, wherein:

the processing unit generates a random key and transmits the random key to the portable device via the wireless module after the portable device establishes connection with the wireless module;

the portable device encrypts an action command with the random key according to the encryption function to obtain the encrypted message; and the electric lock decrypts the encrypted message with the random key according to the decryption function, and the electric lock performs the action command when the electric lock successfully decrypts the encrypted message.

16. The electric lock of claim 15, wherein:

the processing unit encrypts an execution result of performing the action command with the random key according to the encryption function to obtain an encrypted result message; and the wireless module transmits the encrypted result message to the portable device.

17. The electric lock of claim 16, wherein:

the portable device decrypts the encrypted result message with the random key according to the decryption function to read the execution result.

* * * * *